United States Patent [19]

Amsler

[11] 4,041,262

[45] Aug. 9, 1977

[54] CONTACT ARRANGEMENT FOR AN ELECTRICAL SWITCH, ESPECIALLY FOR A VACUUM SWITCH

[75] Inventor: Joachim Amsler, Seon, Switzerland

[73] Assignee: Sprecher & Schuh AG, Aarau, Switzerland

[21] Appl. No.: 590,281

[22] Filed: June 25, 1975

[30] Foreign Application Priority Data

Sept. 2, 1974 Switzerland ..... 11908/74

[51] Int. Cl.[2] ..... H01H 33/66

[52] U.S. Cl. ..... 200/144 B

[58] Field of Search ..... 200/144 B, 146 R

[56] References Cited

U.S. PATENT DOCUMENTS

| | | | |
|---|---|---|---|
| 3,017,480 | 1/1962 | Klaassen | 200/146 R |
| 3,555,223 | 1/1971 | Robinson et al. | 200/144 B |
| 3,773,993 | 11/1973 | Amsler | 200/144 B |

*Primary Examiner*—Robert S. Macon

[57] ABSTRACT

A contact arrangement for an electrical switch, especially a vacuum switch, comprising two contact components movable in one direction relative to one another, each contact component possessing two electrically parallelly connected contact elements, and in the closed condition of the switch each such contact element is in contact with the associated contact element of the other contact component. Further, for the common movement of the contact elements of the movable contact component such contact elements are mechanically coupled with one another.

7 Claims, 1 Drawing Figure

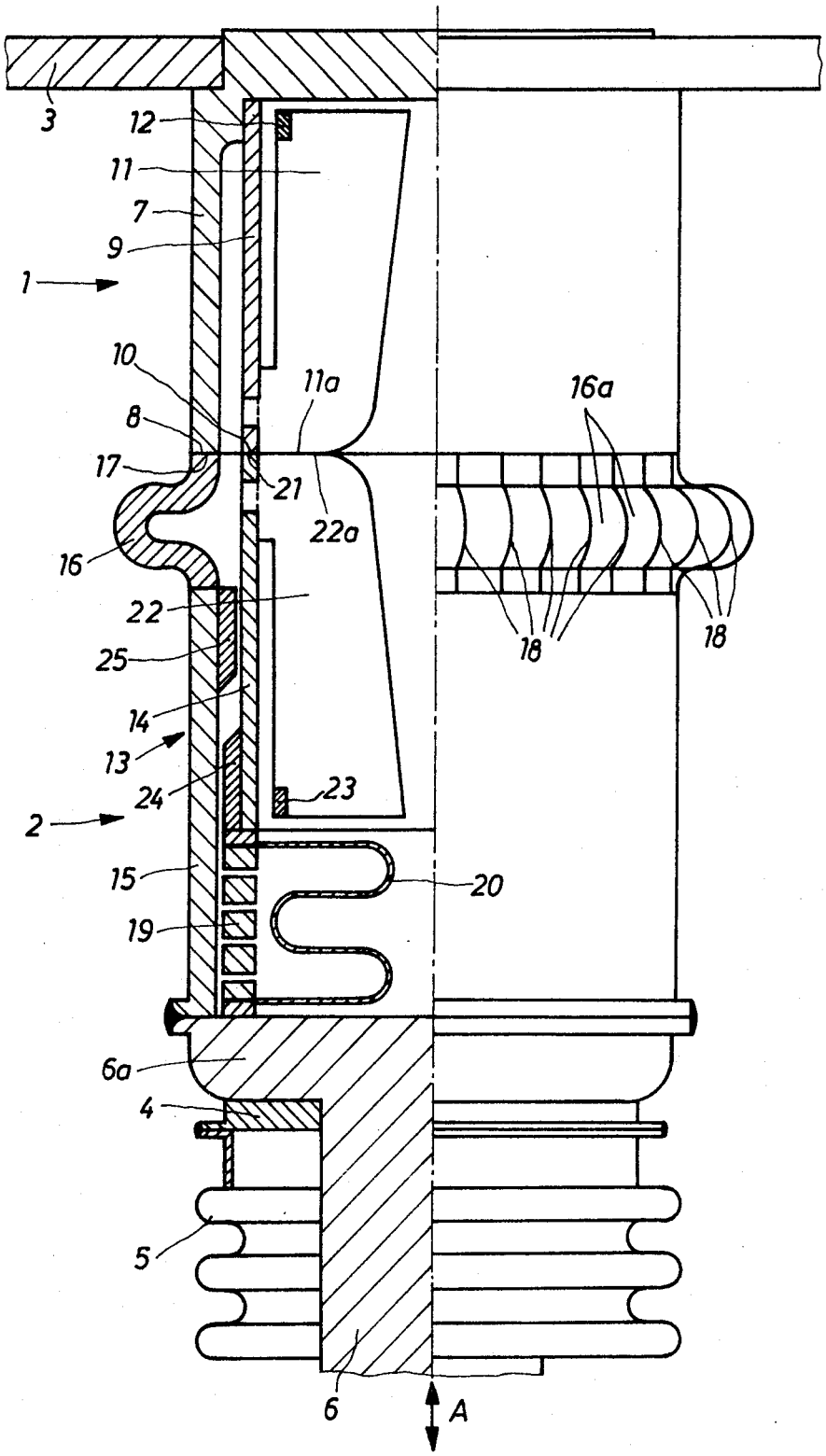
3
12
11
7
9
1
10
8
17
16
22
25
14
13
24
2
15
19
6a
4
5
6
A
11a
21
22a
23
20
16a
18
18

CONTACT ARRANGEMENT FOR AN ELECTRICAL SWITCH, ESPECIALLY FOR A VACUUM SWITCH

BACKGROUND AND SUMMARY OF THE INVENTION

The present invention relates to a new and improved construction of a contact arrangement for an electrical switch, especially for a vacuum switch, comprising two contact components movable relative to one another in one direction.

It is a primary object of the present invention to provide an improved contact arrangement for an electrical switch, especially for a vacuum switch, which is relatively simple in construction, economical to manufacture, and affords reliable contact make-and-brake operations of the switch.

Another and more specific object of the present invention aims at the provision of a new and improved construction of a contact arrangement of the previously amentioned type capable of handling high operating currents and high cut-off currents.

Now in order to implement these and still further objects of the invention, which will become more readily apparent as the description proceeds, the contact arrangement of the previously mentioned type and as contemplated by the invention is manifested by the features that, each contact component comprises two contact elements which are electrically connected in parallel, and in the closed condition of the switch each contact element is in electrical contact with the associated contact element of the other contact component, and for the conjoint or common movement of the contact elements of the movable contact component the contact elements thereof are mechanically coupled with one another.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE thereof illustrates in longitudinal view, partly in section, a preferred exemplary embodiment of a contact arrangement for an electrical switch, especially a vacuum switch, according to the teachings of the present invention.

DETAILED DESCRIPTION OF THE PREFERRED EMBODIMENTS

Describing now the drawing, in the single FIGURE there is partially shown in longitudinal sectional view a contact arrangement for a vacuum switch as contemplated by the teachings of the present invention. The illustrated contact arrangement will be understood to comprise a stationary contact component or portion 1 and a movable contact component or portion 2 which is movable in the direction of the double-headed arrow A. The stationary contact component 1 is connected with an only partially illustrated metallic cover member 3 of a suitable vacuum tight switch housing (not shown) enclosing the contact arrangement. As is well known in this particular field of technology the switch housing furthermore possesses a substantially cylindrical jacket or shell and a metallic floor or bottom, which likewise have been conveniently omitted from the drawing in order to observe clarity in the illustration thereof and inasmuch such are not part of the present invention. In order to maintain the vacuum internally of the switch housing suitable measures are provided as is also well known in this particular art.

The movable contact component 2 is connected via a connection element 4 with one end of a metallic bellows 5 or the like, which is connected at its other end with the aforementioned not particularly illustrated metallic floor of the vacuum or evacuated housing. Extending through the metallic floor and the metallic bellows 5 is a switching rod 6 which is connected with the movable contact component 2, and this switching rod can be moved back-and-forth i.e. up-and-down in the direction of the double-headed arrow A by any suitable and therefor not particularly illustrated actuation mechanism.

The stationary contact component 1 consists of a first outer, substantially hollow cylindrical contact element 7 having a contact surface 8 and a second inner, likewise substantially hollow cylindrical contact element 9 possessing a contact surface 10 and arranged substantially coaxially with respect to the contact element 7. At the inside of the contact element 9 there are mounted sheet metal electrodes 11 or equivalent structure which extend radially practically over the entire axial length of the contact element 9. These sheet metal electrodes 11 are distributively arranged about the periphery of the contact element 9, and between neighboring sheet metal electrodes 11 there is left free in each instance a space or gap. The sheet metal electrodes 11 are additionally fixed in position by means of a reinforcement or anchoring ring 12 or equivalent structure.

The movable contact component 2 likewise possesses a first outer contact element 13 which is essentially hollow cylindrical in construction and a second substantially hollow cylindrical contact element 14 which is arranged substantially coaxially with respect to the first contact element 13.

The outer contact element 13 possesses a substantially ring-shaped or annular component 15 which is connected at one end with the head portion **6*a* of the switching rod 6 and at its other end possesses an elastically deformable, bead-like constructed contact element or piece 16 of essentially U-shaped cross-sectional configuration and which possesses a contact surface 17. The contact element or piece 16 possesses slots 18** extending radially and parallelly with respect to the axis of movement.

At the head portion **6*a* of the switching rod 6 there bears a compression or pressure spring 19 with which there is parallelly connected a current-conducting connection 20. Bearing against the compression or pressure spring 19 is the inner contact element 14 having a contact surface 21. At the inside of the contact element 14 there are mounted, analogous to the contact element 9, sheet metal electrodes 22 or equivalent structure which radially practically over the entire length of the contact element 14. These sheet metal electrodes 22 are distributively arranged about the circumference or periphery of the contact element 14, and similarly a gap or space is left free in each case between neighboring sheet metal electrodes 22. Moreover, the sheet metal electrods 22 are additonally fixed in position by means of a reinforcement or anchoring ring 23**.

At the lower end of the contact element 14 there is mounted at the outside thereof an entrainment ring 24 which, in a manner which will be described more fully hereinafter, cooperates with an entrainment ring 25 arranged at the inside of the annular component 15 at the upper end thereof.

In the showing of the Figure the contact arrangement is illustrated in its closed condition in which the contact surfaces 8 and 17 of the contact elements 7 and 13 and the contact surfaces 10 and 21 of the contact elements 9 and 14 bear against one another.

In this closed condition there is exerted via the switching rod 6 a force at the annular component or portion 15 of the contact element 13 and the compression of pressure spring 19, and by virtue of such applied force this compression spring 19 is compressed together and the contact element or piece 16 pressed against the stationary contact element 7. In this regard it is to be further appreciated that within the contact element 16 there can occur an elastic deformation, resulting in the contact pressure being uniformly distributed at the sections 16*a* of the contact element 16 formed by the slots 18, so that all these sections with their contact surface 17 come into contact with the contact surface 8 of the contact element 7, so that ideal current conducting conditions are ensured between the contact elements 13 and 7.

The somewhat less massive or robust constructed contact elements 9 and 14 are likewise pressed against one another by the compression of pressure spring 19, so that current also flows through these contact elements 9, 14. This current is conducted through the current-conducting connection 20 in order to relieve the compression spring 19.

During shutting-off of the current flowing through the contact arrangement the switching rod 6 is moved downwards by means of a suitable tension or traction force. The movable contact component 2 is thus accelerated downwardly, so that the contact element 13 is separated from the contact element 7. Under the action of the compression spring 19 the contact element 14 initially remains in contact with the contact element 9. The total current flows through these contact elements 9 and 14 provided that the total ohmic and inductive voltage drop at such contact elements 9 and 14 has not exceeded a predetermined critical value, for instance 20 volts. In this case no arc can exist between the opened contact elements 7 and 13, so that in this case there does not occur any contact burn-off.

As soon as during the opening movement of the contact element 13 the entrainment ring 25 bears against the entrainment ring 24, —which occurs after several milliseconds— then the contact element 14 is likewise moved downwards towards its open position through the agency of this mechanical coupling. This movement occurs at a great speed, since the contact element 13 in the meantime has attained a large speed or velocity (approximately 3 m/s) and the contact element 14 is entrained practically without any delay owing to its relatively small mass.

Between the contact surfaces 10 and 21 of the contact elements 9 and 14, respectively, there burns an arc, which, however, under the action of the self-magnetic field commutates from the contact surfaces 10 and 21 to the narrow surfaces 11*a* and 22*a* of the sheet metal electrodes 11 and 22 respectively, and at the location burns diffuse until it is extinguished during the next null throughpassage or crossover of the current.

Upon closing the contact arrangement or contact components 1 and 2 initially both of the contact elements 9 and 14 necessarily close, so that an arc which is present due to pre-ignition likewise commutates in the described manner to the sheet metal electrodes 11 and 22. The outer contact elements 7 and 13 thus can close in a currentless fashion and without contact bounce or chattering, so that also no contact burn-off occurs during closing of the switch.

The switching rod 6 together with the head portion 6*a*, the contact elements 7, 9, 13, and 14 and the connection member 20 may be advantageously formed of copper, whereas the connection element 4, the metallic bellows 5, the floor and cover 11 of the vacuum housing, the compression spring 19, the entrainment rings 24 and 25 and the sheet metal electrodes 11 and 22 may be advantageously formed of iron or steel.

The contact piece or element 16 is pre-formed in the shape apparent from the Figure and mounted in a soft annealed condition. To impart the final shape it is pressed via the switching rod 6 against the contact element 7 with a pressure which is at least twice as large as the contact pressure exerted throughout the normal range of operation. Consequently, the individual partial contacts 16*a* of the contact piece or element 16 which are separated from one another by the slots 18 experience a non-elastic deformation in such a way that all partial contacts 16*a* come into contact with the stationary countercontact element 7 at the contact surface 8. At the same time the contact piece or element 16 experiences a hardening brought about by the deformation, so that it permanently retains the imparted shape or configuration.

Instead of the illustrated embodiment of sheet metal electrodes 11 and 22 which have been shown and described by way of example, it is to be specifically understood that there could be equally readily employed other suitably constructed electrode elements for the reception of the base points of the arc, such as for instance as described in Swiss Patent 531,784 and the corresponding United States patent 3,866,005, granted February 11, 1975, the disclosure of which is incorporated herein by reference.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A contact arrangement for an electrical switch, especially for a vacuum switch, comprising two contact components movable relative to one another in a first predetermined direction, said contact components having a closed position, one of said contact components defining a movable contact component, the other of said contact components defining a stationary contact component, each of said contact components comprising two contact elements electrically connected in parallel, said contact elements of each of said contact components having an essentially hollow cylindrical configuration and being arranged substantially coaxially with respect to one another to define respective outer and inner contact elements, each of said contact elements having a contact surface, the inner contact and the outer contact elements of said contact components being axially positioned in the direction of movement of said movable contact component, each of said contact elements of said one of said

2. The contact arrangement as defined in claim 1, wherein said entrainment connection means comprises a first entrainment element arranged at the inside of said outer contact element and a second entrainment element arranged at the outside of said inner contact element of said movable contact component, both entrainment elements being arranged in spaced relationship from one another in the direction of movement of said switching element in the closed position of said contact components.

3. The contact arrangement as defined in claim 1, wherein the deformable contact piece is formed with slots extending substantially radially and parallelly with respect to the direction of movement of said switching element, said slots being distributively arranged in spaced relationship from one another about the periphery of said deformable contact piece.

4. The contact arrangement as defined in claim 1, wherein said contact piece has a substantially U-shaped cross-sectional configuration.

5. The contact arrangement as defined in claim 1, wherein said compression spring is bridged by an electrically conductive connection element connected in parallel with said compression spring.

6. The contact arrangement as defined in claim 1, wherein the inner contact element of each contact component is provided at its inside with electrode elements for receiving the arc base points.

7. The contact arrangement as defined in claim 1, wherein the electrode elements comprise substantially radially extending sheet metal electrodes which are distributively arranged about the periphery of the inner contact element, and gaps maintained free between neighboring ones of said sheet metal electrodes.

* * * * *